US011367423B2

(12) United States Patent
Gale

(10) Patent No.: US 11,367,423 B2
(45) Date of Patent: Jun. 21, 2022

(54) SNARE MUFFLER

(71) Applicant: Darren Gale, Orange, MA (US)

(72) Inventor: Darren Gale, Orange, MA (US)

( * ) Notice: Subject to any disclaimer, the term of this patent is extended or adjusted under 35 U.S.C. 154(b) by 0 days.

(21) Appl. No.: 17/092,292

(22) Filed: Nov. 8, 2020

(65) Prior Publication Data

US 2022/0148544 A1 May 12, 2022

(51) Int. Cl.
*G10D 13/14* (2020.01)
*G10D 13/02* (2020.01)

(52) U.S. Cl.
CPC ..... *G10D 13/14* (2020.02); *G10D 13/02* (2013.01)

(58) Field of Classification Search
CPC ..... G10D 13/14; G10D 13/02
See application file for complete search history.

(56) References Cited

U.S. PATENT DOCUMENTS 590,182 A 9/1897 Bower
609,068 A 8/1898 Zeidler
1,281,107 A 10/1918 Valkenburg
1,892,223 A 12/1932 Sansone et al.
2,078,004 A * 4/1937 Lebow ..... G10D 13/02 84/411 R
2,499,616 A 3/1950 Walberg
2,564,933 A 8/1951 Somerville
2,572,504 A 10/1951 Meriwether
D228,023 S 7/1973 Grauso
3,951,032 A 4/1976 LaPorta et al.
4,158,980 A 6/1979 Gauger
4,203,343 A 5/1980 Bargeman
4,246,825 A 1/1981 Hodas
D316,423 S 4/1991 Montineri
D322,623 S 12/1991 Craviotto et al.
5,520,083 A 5/1996 Falkner, Jr.
5,616,875 A 4/1997 Lombardi
5,763,797 A 6/1998 Loendorf
5,877,440 A 3/1999 Chaffee et al.
5,959,227 A 9/1999 Shapiro
5,986,197 A 11/1999 Allen
6,291,754 B1 * 9/2001 Gatzen ..... G10D 13/02 84/411 M
6,307,133 B1 10/2001 May et al.
D564,012 S 3/2008 Montineri
D580,477 S 11/2008 Sikra et al.
8,163,988 B2 4/2012 Holl et al.
D679,744 S 4/2013 Hudson
D703,261 S 4/2014 Hudson
9,631,652 B2 4/2017 Krol et al.
(Continued)

*Primary Examiner* — Jianchun Qin

(57) ABSTRACT

A device for use in combination with a musical snare drum for altering the sounds produced consisting of a means for affixing the device to the drum, such as a bracket assembly, mounted on the upper and lower rims of the drum, connected to the bracket assembly is a flexible banding which extends around the top, sides, and bottom of the drum and is attached in a manner that allows for ease of movement along the long axis of the banding so that it can be adjusted by sliding along said axis, a muffler component composed of a felt pad or other suitable material is affixed to the flexible banding and positioned on the bottom of the drum in a manner that provides for the muffler to be repositioned at varying degrees of contact with the snares by advancing or retracting the banding so as to alter the tonal output.

6 Claims, 1 Drawing Sheet

(56) References Cited

U.S. PATENT DOCUMENTS

| | | | | |
|---|---|---|---|---|
| 10,418,005 | B2 * | 9/2019 | Shepard | G10G 1/00 |
| 10,643,589 | B1 | 5/2020 | McKee | |
| 2007/0157793 | A1 * | 7/2007 | Ischer | G10D 13/02 84/411 M |
| 2019/0019479 | A1 * | 1/2019 | Strickland | G10D 13/02 |

* cited by examiner

SNARE MUFFLER

CROSS-REFERENCE TO RELATED APPLICATIONS

Not Applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Field of the Invention

The present invention relates generally to the area of musical instruments. More particularly, the invention is directed to the interface between a drumhead and a snare component as a device for adjustably modifying the sounds produced by said interface to provide a desired musical tone.

Description of the Prior Art

Drumhead dampening devices, also known as internal and external tone controls, have existed in the prior art for many years. Internal tone controls typically are mounted inside the drum shell with a pressure adjustment knob or actuator element mounted through the shell wall to give the musician easy access to operate the device. The internal tone control employs a head element with a felt pad or some other suitable object that presses against the underside of the drumhead, which affects the dampening of the sound. External tone control devices have the same ultimate effect, i.e. to dampen the sound from the drumhead, though this version of the device employs an external mount, which may be attached to any suitable component of the drumshell, such as the counterhoop. Instead of the head element or pad pressing against the underside of the drumhead, as with the internal control, pressure is exerted from above, upon the drumhead's upper surface. The actuator can be an external lever, a knob or any other suitable device. With both versions, the actuator must be manually operated by the drummer to lock the felt pad or some other suitable element in place against the drumhead. The pressure exerted by these devices is constant. Neither device provides the pad the means to automatically modify the snare interface to the musician's requirements to selectively eliminate undesirable tones at various times during play. Specifically, prior art tone control devices lack the means to adjust the pressure of the pad against the drumhead and snare interface, the ratio of the snare component in contact with the drum head and the location of the pad on the surface. Maximum dampening is achieved when the pad is positioned near the center of the drumhead and in full obstruction of the snare interface. Minimum dampening is achieved when the pad is positioned near the edge of the drumhead and with minimal or no obstruction of the snare interface. The prior art devices are without the means to accomplish even this seemingly simple adjustment.

Accordingly, there is a need in the art to provide a dampening device for a drumhead that has an external mounting feature with the means to easily adjust the location of the pad that presses against the drumhead surface, adjust the amount of pressure the pad exerts on the drumhead surface, and adjust the time interval ("gate time") the pad exists off the drumhead surface in response to an object striking the surface as well as selectively dampen or obstruct the snare interface in a dynamically variable manner. The device should also be easy to mount on an external component of the drum, such as the counterhoop, simple to remove and easy to operate without any significant interference with the playing of the instrument.

BRIEF SUMMARY OF THE INVENTION

The present invention provides a device for use in combination with a musical drum for dampening and or modifying the tones produced by the interface of the lower drumhead and snare component. The invention consists of a means for affixing the device to the drum, such as, for example, a slotted bracket assembly, attached to the upper and lower tensioning rims of the drum in a fixed manner, positioned horizontally in an offset parallel alignment with the upper and lower drumheads. Within the bracket assembly, a horizontally elongated opening forms an aperture which has a smooth interior. Running through the aperture within the bracket assembly is a flexible banding material which is routed in a closed loop around the outer surface of the drum, horizontally traversing above, and with the widest dimension of the banding in parallel to, the upper "battery" drumhead, then extending vertically along the outside of the drum shell component without contacting the drum itself other than the slotted bracket assembly. The flexible banding material then traverses below, and in parallel to, the lower drumhead and snare interface where a mounting plate containing the means to quickly attach or remove a muffling component without the use of tools and by means of ordinary and conventional hand manipulation is affixed in a horizontal orientation to the flexible banding material. Attached to the mounting plate is a muffling component which is tapered at one end and fluted along the upper surface which is in contact with the lower drumhead and is made of a compressed felt or other similarly suitable material. The muffling component geometry allows for varying levels of contact with the snare component along the lower drumhead, while the flexible banding routed through the slotted bracket assembly allows for repositioning of the muffler to actively change the interface during musical play by manually sliding the flexible banding along its longest axis, through the bracket assembly so that the muffler component is caused to be repositioned along the axis of the flexible banding across the surface to the lower drumhead. Adjustment of the positioning of the muffler component provides two primary effects on the musical sounds being produced. By repositioning the muffler component horizontally along the snare and lower drumhead interface to dampen some, all, or none of the snare component and in turn affect the tonal quality of the instrument, as well as to reposition the muffler component proximally or distally along the lower drumhead to affect the resonance duration of the drum during play. Positioning the muffler component distally along the drumhead and in contact with none of the snare component will result in little to no effect on the tonality of the instrument, while positioning the muffler component proximally along the lower drum head will result in a shortened resonance duration, and positioning the muffler component so that it is in contact with all or most of the snare component will result in a substantial change in the resulting tone of the instrument.

Accordingly, an object of the present invention is to provide a device that selectively dampens undesirable drumhead ring and resonance duration.

Another object of the present invention is to provide a device that selectively modifies the tonal output of the instrument created by the interface of the snare component and lower drumhead.

Another object of the present invention is to provide an externally mounted device for dampening undesirable drumhead ring and resonance duration.

Another object of the present invention is to provide an externally mounted device that selectively modifies the tonal output of the instrument created by the interface of the snare component and lower drumhead.

Another object of the present invention is to provide a device for dampening undesirable drumhead ring and resonance duration that can adjust to various positions on the drumhead surface to minimize or maximize the dampening effect.

Another object of the present invention is to provide a device that selectively modifies the tonal output of the instrument created by the interface of the snare component and lower drumhead that can adjust to various positions on the snare component and drumhead interface to minimize or maximize the modifying effect.

Still another object of the present invention is to provide a device for dampening undesirable drumhead ring and resonance duration with the means to adjust the positioning of the muffler component proximally and distally upon the lower drumhead surface.

Still another object of the present invention is to provide a device that selectively modifies the tonal output of the instrument created by the interface of the snare component and lower drumhead by variably muffling some, all, or none of the snare component interface with the lower drumhead.

Still yet another object of the present invention is to provide a device for dampening undesirable drumhead ring and resonance duration that is easy for the musician to operate while playing the instrument.

Still yet another object of the present invention is to provide a device that selectively modifies the tonal output of the instrument created by the interface of the snare component and lower drumhead that is easy for the musician to operate while playing the instrument.

Still yet another object of the present invention is to provide a device for dampening undesirable drumhead ring and resonance duration that is easy and cost effective to manufacture.

Still yet another object of the present invention is to provide a device that selectively modifies the tonal output of the instrument created by the interface of the snare component and lower drumhead that is easy and cost effective to manufacture.

Other objects and advantages of the present invention will become apparent in the following specifications when considered in light of the attached drawings wherein a preferred embodiment of the invention is illustrated.

BRIEF DESCRIPTION OF THE SEVERAL VIEWS OF THE DRAWING(S)

DETAILED DESCRIPTION OF THE INVENTION

Figure 1:
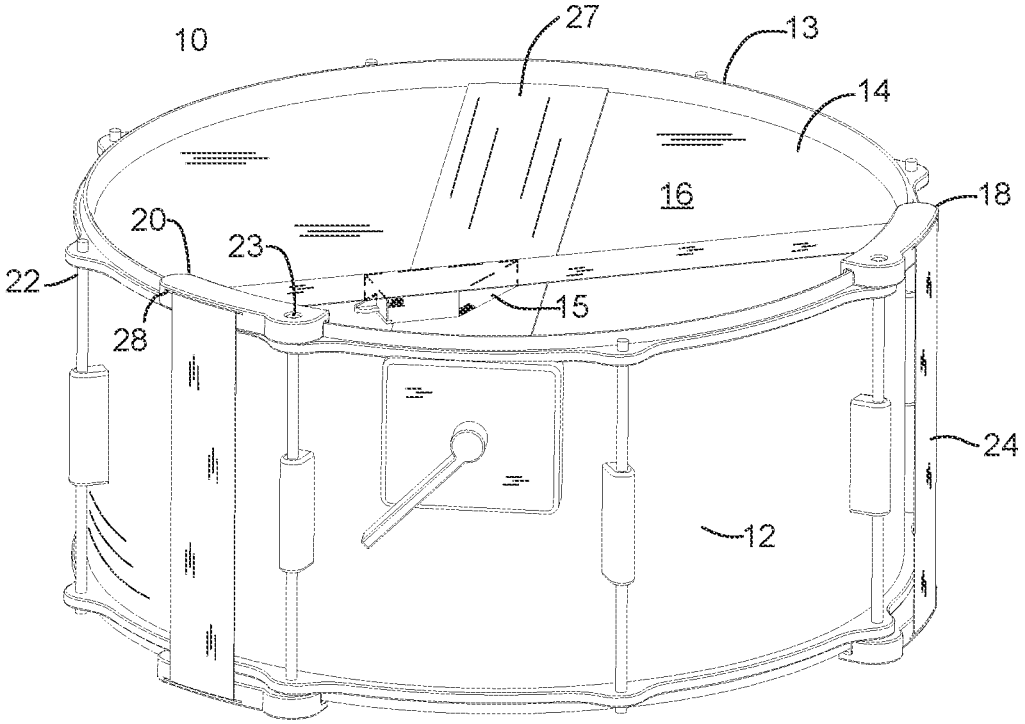
FIG. 1 is a perspective view of the device in accordance with the present invention.
Figure 2:
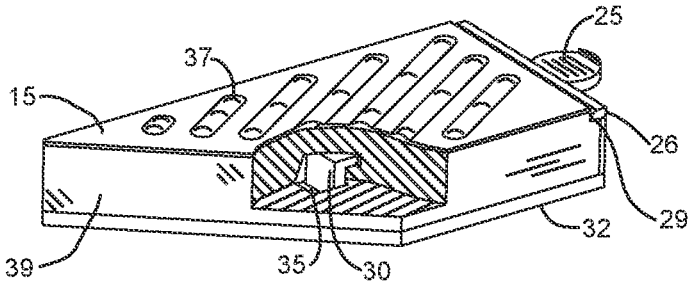
FIG. 2 is an enlarged perspective of the muffler component and related components in accordance with the present invention.

The preferred embodiment of the present invention, as shown in FIGS. 1 and 2, provides a device 10 for use in combination with a musical drum 12, typically a snare drum, which includes a rim 13, and a drumhead 14 having a drumhead surface 16 and commonly, but not exclusively, a snare component 27. Bracket assembly 18 or any other suitable means is employed to affix the device 10 to any appropriate mounting structure on a drum 12, such as, for example, drum rim 13. Bracket assembly 18 includes a curved bracket 20, threaded lug (tension rod) 22, flexible banding material 24 tightly wrapped around the drum rims 13, and routed through a horizontally elongated aperture 28. Mounting plate 32, with an L-shaped hook 30, and barbed clasp 26 with a textured wing 25, for use in securing a muffler component 15 which consists of a tapered geometry 39 with a fluted upper surface 37 and containing a recessed cavity 35 aligned with L-shaped hook 30 as well as an inset grove 29 corresponding with the barbed clasp 26 for the purpose of retaining and securely affixing muffler component 15. The threaded lug (tension rod) 22 is used to secure the bracket 20 to the drum rim 13 by means of a friction press-fit with bracket aperture 23 or by any other conventional manner such as adhesive, threaded fastener, or by using any other suitable means for this purpose.

Components employed for device 10 are comprised of either metal alloy, such as aluminum or steel, natural material, such as rubber, resilient material or synthetic materials, such as polyethylene, nylon, or a combination of these. In practice, device 10 is secured tightly to rim 13 at both the upper and lower rims, located vertically and horizontally opposed, by employing bracket assembly 18. Muffler component 15 is positioned by the musician at a selected location on the drumhead surface 16. Flexible banding 24 is adjusted by sliding along its longest axis through horizontal aperture 28 to locate muffler component 15 on the drumhead surface 16. The resonance duration is then modified by adjusting the positions of muffler component 15 distally or proximally along the lower drumhead surface 16. Modification of the tonal output of the instrument created by the interface of snare component 27 and lower drumhead 14 is achieved by ensuring that the directional track of muffler component 15 is oriented to traverse the snare component 27 when manipulated to variably contact some, all, or none of the snare component 27 interface with the lower drumhead surface 16.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A device for dampening and or modifying the tones produced by the interface of the drumhead surface and snare component, comprising;

a bracket assembly which is attached to the rim in four opposing locations; a flexible banding constrained by way of a horizontally elongated aperture within said bracket assembly which is axially manipulated therein; a mounting plate consisting of an L-shaped hook, barbed clasp, and textured wing which is attached to said flexible banding in an orientation that places the barbed clasp and L-shaped hook facing the drumhead;

a muffler component consisting of a fluted surface and possessing an inset groove corresponding with the barbed clasp and recessed cavity aligned with L-shaped hook for retention of the muffler component to the mounting plate.

2. The invention of claim 1 wherein the positioning of said bracket assembly is able to be adjusted in such a way to allow the placement of said muffling component distally and proximally relative to said drumhead.

3. The invention of claim 1 wherein said muffler comprises a mounting plate and a muffler component.

4. The invention of claim 3 wherein said muffler component is comprised of a resilient material.

5. The invention of claim 1 wherein said muffler component can be physically adjusted without the use of special tools or equipment; from an area generally distal to the center of said drumhead; to an area generally proximal to the center of said drumhead; to adjust the duration and intensity of the vibration of said drumhead.

6. The invention of claim 1 wherein repositioning of said muffler component horizontally along the snare and lower drumhead interface will cause said muffler component to dampen some, all, or none of the snare component and in turn affect the tonal quality of said snare component.

* * * * *